US006386690B2

(12) United States Patent
Kawanabe

(10) Patent No.: US 6,386,690 B2
(45) Date of Patent: May 14, 2002

(54) INK REPLENISHING SYSTEM AND METHOD FOR INK JET PRINTING APPARATUS

(75) Inventor: Tetsuya Kawanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/860,552

(22) Filed: May 21, 2001

(30) Foreign Application Priority Data

May 24, 2000 (JP) ..... 2000-153631

(51) Int. Cl.[7] ..... B41J 2/175
(52) U.S. Cl. ..... 347/85
(58) Field of Search ..... 347/84, 85, 23, 347/27

(56) References Cited

U.S. PATENT DOCUMENTS 4,609,925 A * 9/1986 Nozu et al. ..... 347/27
6,227,646 B1 * 5/2001 Yano et al. ..... 347/23

* cited by examiner

*Primary Examiner*—Anh T. N. Vo
(74) *Attorney, Agent, or Firm*—Fitzpatrick, Cella, Harper & Scinto

(57) ABSTRACT

A present invention provides an ink jet printing apparatus comprising an ink replenishing system which prevents ink leakage when a power supply from a main power source is cut off due to a power failure or the like while an ink reserving section of a print head of the ink jet printing apparatus is replenished with ink. The ink replenishing system is capable of properly managing the amount of ink in the ink reserving section. In the ink jet printing apparatus, when a power supply from a main power source is cut off after the start of an ink replenishing operation, power is supplied from a secondary power source so that ink replenishing control is executed depending on the power state of the secondary power source. If the ink replenishing operation has not been completed, after the main power source is recovered, the ink replenishing operation is performed again.

10 Claims, 8 Drawing Sheets

INK REPLENISHING SYSTEM AND METHOD FOR INK JET PRINTING APPARATUS

This application is based on patent application No. 2000-153631 filed May 24, 2000 in Japan, the content of which is incorporated hereinto by reference.

BACKGROUND OF THE INVENTION

1. Field of the Invention

The present invention relates to a printing apparatus for forming images on printing medium, and in particular, to an ink replenishing system for replenishing an ink reserving section of a print head of an ink jet printing apparatus with ink.

2. Description of the Related Art

In the field of image printing apparatuses, colors, printing speed, definition, and image quality have lately been improved to enable the output of a large amount of high-grade images that appear like photographs. In particular, an increasing number of fast printing apparatuses that act as shared equipment through network connections have been demanded.

In these circumstances, ink jet printing apparatuses are required to increase the amount of ink stored for printing to reduce the frequency with which ink must be supplied, in order to reduce the running costs of the equipment and to enable easy maintenance. To meet such requirements, a method has been proposed which is used in a system for replenishing an ink reserving section of a print head of an ink jet printing apparatus with ink from an ink replenishing section, to move the ink reserving section to the ink replenishing section and connect the ink replenishing section to the ink reserving section via an opening formed therein to replenish the ink reserving section with ink.

With this conventional method, to move a carriage having the ink reserving section mounted therein to the ink replenishing section of the print head in order to replenish the ink reserving section with ink or to replenish the ink reserving section with ink from the ink replenishing section after the ink replenishing section has been connected to the ink reserving section via a pipe, it is necessary to control driving of an actuator for driving the carriage, a supply valve, a pressurizing pump, or the like.

After, however, an ink replenishing operation has been started, if a power failure or accidental cutting of a power supply line occurs during ink replenishing operation control, the operation of the actuator is immediately stopped to cause the carriage movement as well as the valve and the pump to be inappropriately controlled, resulting in ink leakage from connections or the like. Additionally, if a main power supply is cut off during the ink replenishment operation, the amount of ink already supplied is disadvantageously unknown, thereby hindering the amount of ink in the ink reserving section from being properly managed after the main power supply has been recovered.

SUMMARY OF THE INVENTION

To solve these problems, the present invention provides an ink replenishing system for replenishing an ink reserving section of a print head of an ink jet printing apparatus with ink from an ink replenishing section. In the ink replenishing system, the ink reserving section is configured so as to be connected to and separated from the ink replenishing section via an opening formed in the ink reserving section. An object of the present invention is to provide an ink jet printing apparatus comprising an ink replenishing system which is configured so as to replenish the ink reserving section with ink by controlling the driving of an actuator and which switches, when a power supply from a main power source is cut off after the start of an ink replenishing operation, to a power supply by a secondary power source and controls the replenishing operation depending on a power state of the secondary power source.

Further, when the power state of the secondary power source is such that it has sufficient power to complete the ink replenishing operation, the replenishing operation is controlled so as to complete the connection operation, the ink replenishing operation, and the separation operation. When the power state of the secondary power source is such that it does not have sufficient power to complete the ink replenishing operation, the ink replenishing operation is suspended and at least the separation operation is completed. Furthermore, the amount of ink supplied before the ink replenishing operation is suspended is stored, and when the main power supply is subsequently recovered, the ink replenishing operation is performed again to replenish the ink reserving section with an amount of ink sufficient to compensate for the shortage. It is another object of the present invention to provide an ink jet printing apparatus comprising an ink replenishing system configured as described above.

The above and other objects, features and advantages of the present invention will become more apparent from the following description of embodiments thereof taken in conjunction with the accompanying drawings.

DETAILED DESCRIPTION OF THE PREFERRED EMBODIMENT

Figure 1:
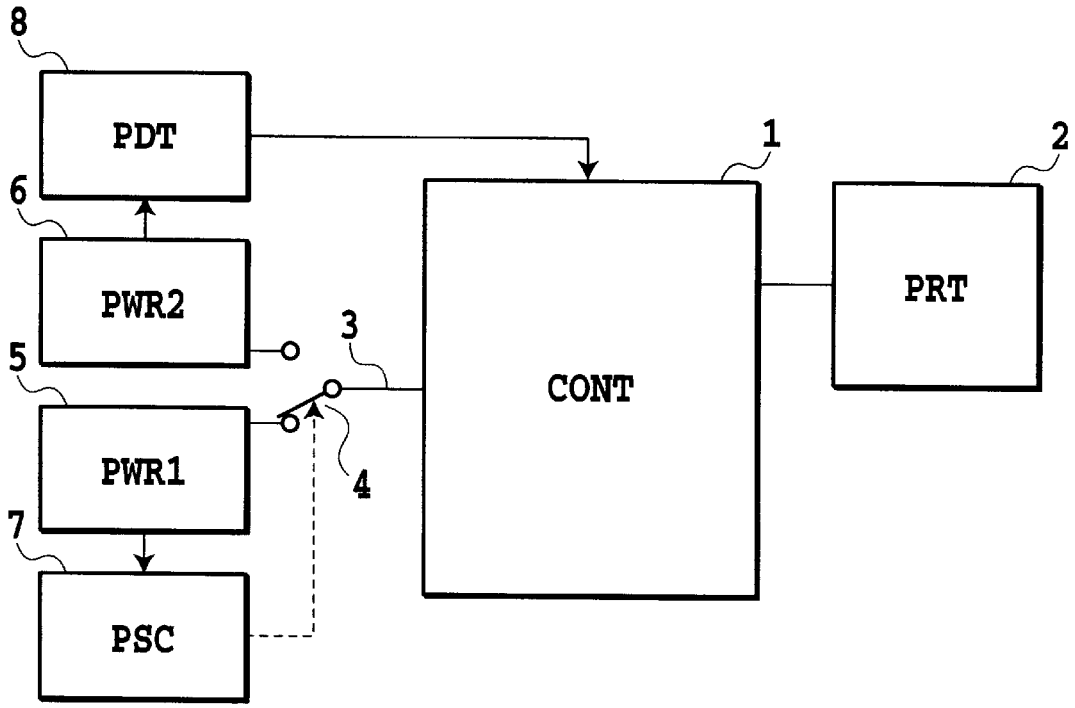
FIG. 1 is a view showing the configuration of a printing apparatus to which the present invention is applicable.

FIG. 1 is a view useful in explaining a configuration of a printing apparatus to which the present invention is applicable. A control circuit (CONT) 1 controls the entire printing apparatus of the present invention and, although not shown, comprises a CPU, a RAM, an NVRAM (non-volatile memory), a ROM, an I/O port, a DMA controller, a programmable timer, an interruption controller, an actuator driving circuit, an interface control circuit, and others. A printing mechanism (PRT) 2 comprises a print head, a carriage, a printing medium feeding mechanism, an ink replenishing system, and others.

The control circuit 1 operates in accordance with programs previously stored in the ROM to control the entire operation of the printing apparatus by executing printing output in accordance with demands from a host computer or the like connected thereto through an interface as required and controlling an ink replenishing operation as required.

Power supply devices are denoted by reference numerals 3 to 8. Reference numeral 3 denotes a power supply line to the control circuit 1. Reference numeral 5 denotes a main power source (PWR1) for normally supplying power to the printing apparatus, reference numeral 6 denotes a secondary power source (PWR2) composed of batteries, for supplying power in an emergency, and reference numeral 4 denotes a switcher. Reference numeral 7 denotes a power source switching control means (PSC) for monitoring the voltage at the main power source 5 to switch, on detecting a decrease in the voltage at the main power source 5 which is caused by a power failure or the like, the switcher 4 to the secondary power source 6 side, while transmitting a switching signal to inform the control circuit 1 of this decrease by means of interruption or the like. Reference numeral 8 denotes a secondary-power-source voltage detector (PDT) for monitoring the voltage at the secondary power source 6 and transmitting, on detecting a voltage equal to or lower than a predetermined value, a detection signal to inform the control circuit 1 of this low voltage by means of interruption. The secondary power source 6 may be composed of chargeable batteries; in this case, a charge control circuit may be added thereto.

Figure 2:
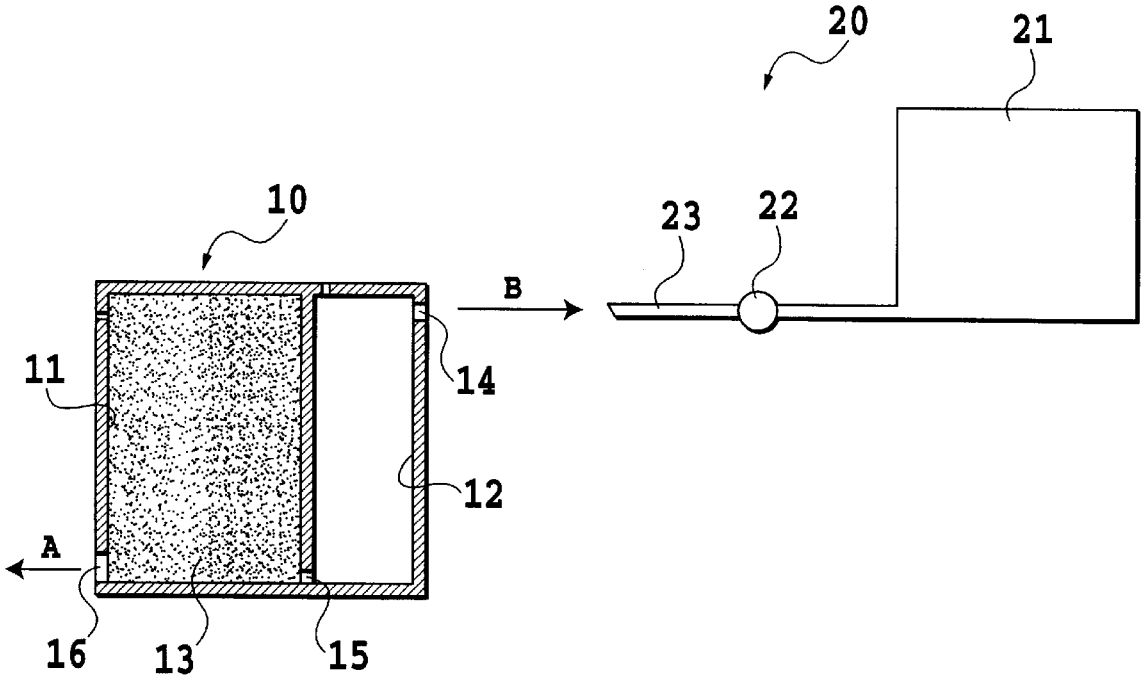
FIG. 2 is a view showing an ink replenishing system of a first embodiment, wherein an ink reserving section separates from an ink replenishing section.

A first embodiment of the ink replenishing system of the present invention will be described with reference to FIGS. 2 to 6. In FIG. 2, reference numeral 10 denotes an ink reserving section for replenishing the print head with ink, the ink reserving section being provided on the carriage (not shown) together with the print head. The ink reserving section 10 has a first liquid chamber 11 and a second liquid chamber 12 which are in communication with each other via a communication passage 15. The first liquid chamber 11 is filled with a liquid absorbent 13 and has a supply passage 16 in communication with the print head (not shown). The ink stored in the second liquid chamber 12 gradually permeates through the liquid absorbent 13 through the communication passage 15. The ink permeating through the liquid absorbent 13 passes through the supply passage 16 to replenish the print head with an amount of ink required for printing (the ink is supplied in the direction of an arrow A).

The liquid absorbent 13 is composed of a porous material, for example, spongy plastics, foam rubber, or a fibrous material, and its pores forms capillaries for a liquid. Reference 14 denotes an opening formed in the second liquid chamber and connected, during an ink replenishing operation, to a supply pipe 23 of an ink replenishing section 20, described later.

The ink replenishing section 20 is fixed to a main body side of the ink jet printing apparatus. In this embodiment, the ink replenishing section 20 is of a type that supplies a liquid utilizing a difference in the water head. It comprises an ink storage chamber 21, a supply valve 22, and a supply pipe 23 that can be connected to the opening 14 in the second liquid chamber 12 during the ink replenishing operation. The supply valve 22 is configured to have its driving controlled by an actuator (not shown) so as to be opened and closed as required.

Figure 3:
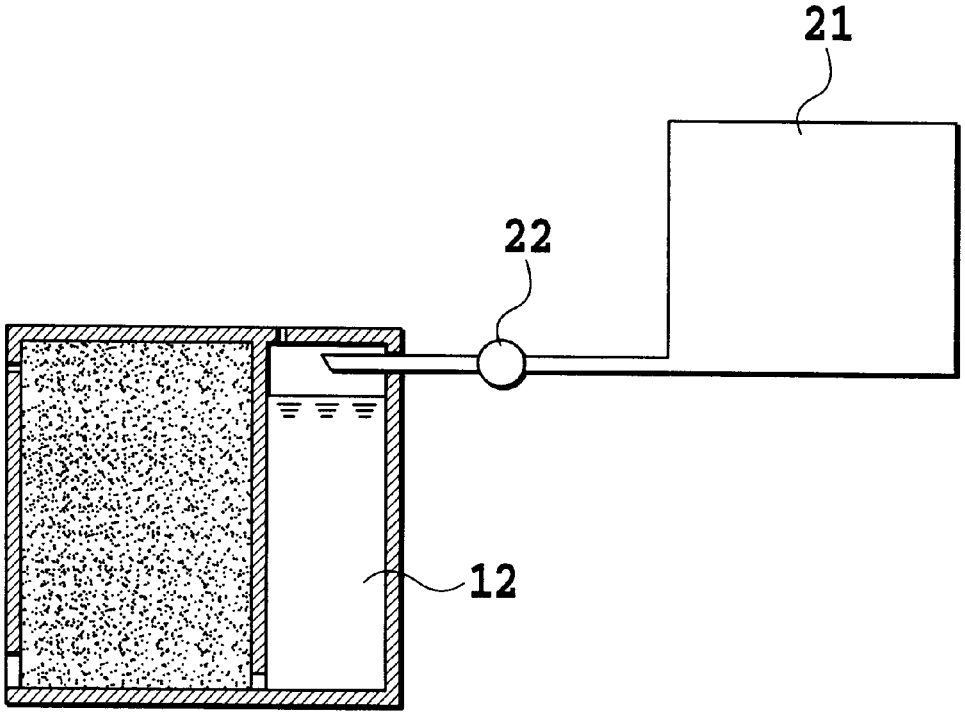
FIG. 3 is a view showing the ink replenishing system of the first embodiment, wherein an ink reserving section connects to an ink replenishing section.

During the ink replenishing operation, the driving of the actuator (not shown) for scanning the carriage during a printing operation is controlled to move the carriage having the ink reserving section 10 mounted thereon, in the direction of the arrow B in FIG. 2 from the position shown in FIG. 2 to the position shown in FIG. 3, ("connection operation"). At this time, the ink reserving section 10 is stopped at a position into which it does not advance during a normal printing operation, so as not to effect unwanted load motion on the carriage during the printing operation.

As shown in FIG. 3, the second liquid chamber 12 can be replenished with a desired amount of ink from the ink storage chamber 21 by opening the supply valve 22 with the supply pipe 23 connected to the opening 14. Once the ink replenishing operation is completed, the supply valve 22 is closed, the carriage having the ink reserving section 10 mounted thereon is moved, by controlling the driving of the actuator (not shown), in the direction opposite to that during the connection operation so as to return to its initial state as shown FIG. 2 ("separation operation").

Figure 4:
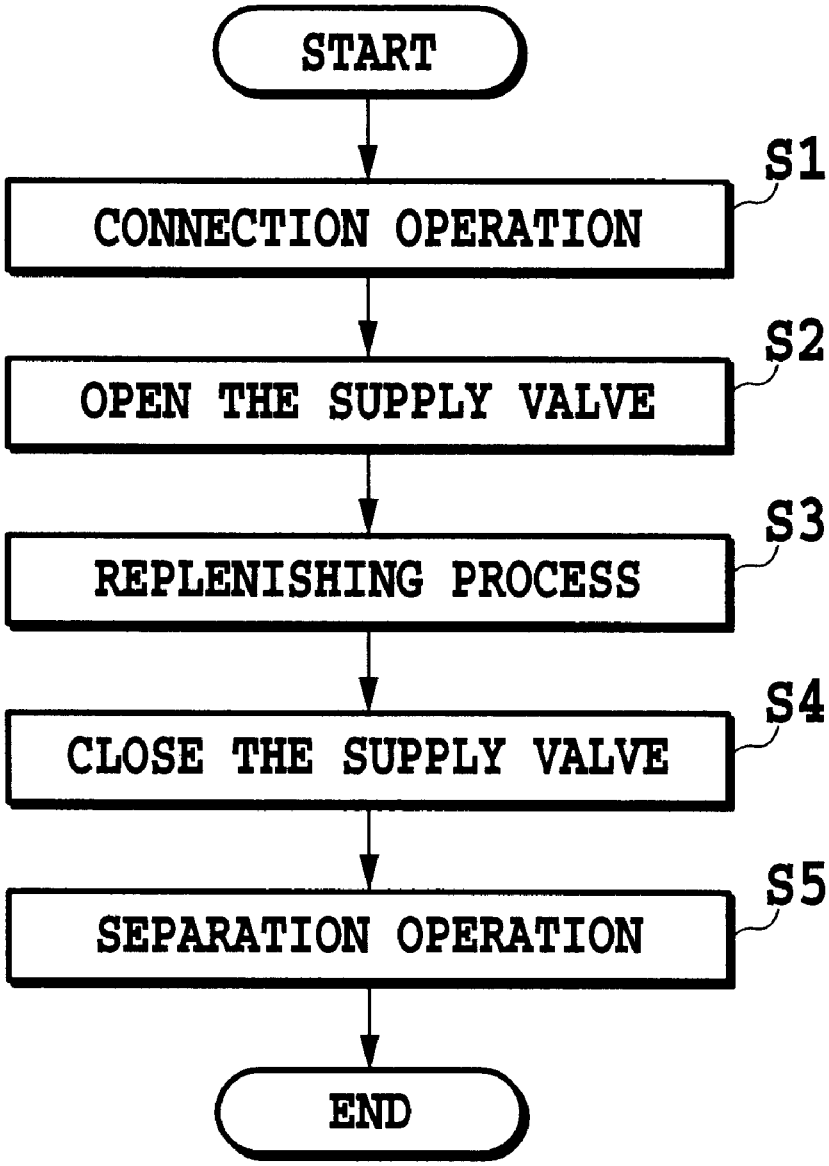
FIG. 4 is a flow chart showing ink replenishing operation control of the first embodiment.
Figure 5:
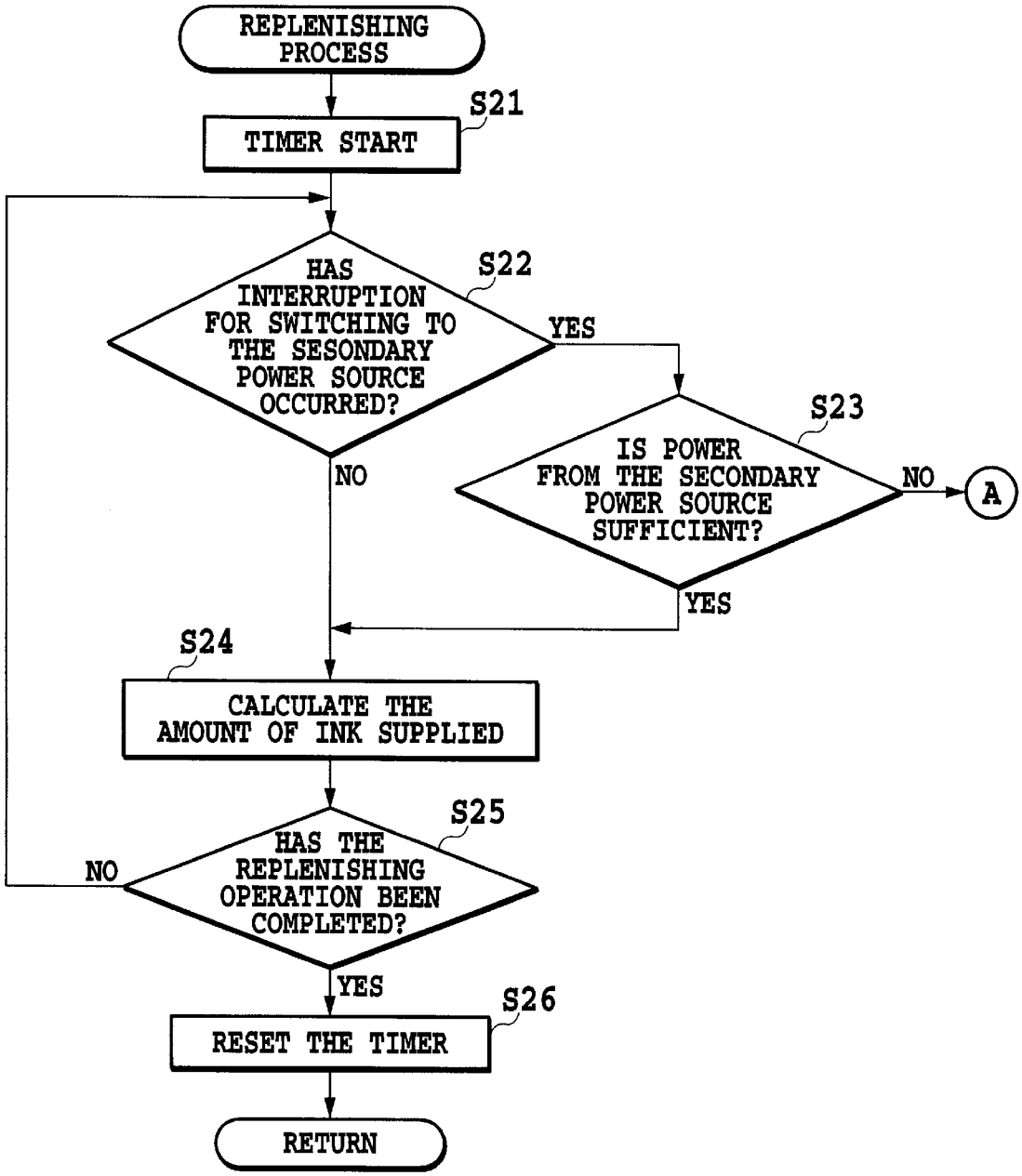
FIG. 5 is a flow chart showing the replenishing process from FIG. 4 in detail.

FIGS. 4 and 5 are flow charts useful in explaining the ink replenishing operation control performed while power is being supplied by the main power source 5. This control is programmed in the ROM in the control circuit 1 in advance. The normal control (performed while power is being supplied by the main power source 5) of the ink replenishing operation starts when, for example, a detection signal sensing that the level in the second liquid chamber 12 has decreased down to a predetermined value is input to the control circuit 1.

The power state of the secondary power source 6 is always monitored by the control circuit 1 utilizing a detection signal from the secondary power source voltage detector 8. Accordingly, when the secondary power source voltage detector 7 detects a state where the voltage at the secondary power source 6 is so low that an emergency replenishing operation cannot substantially be achieved (at least the operation of closing the supply valve 22 and separating cannot be performed), the ink replenishing operation is disabled beforehand and this is warned to an operator beforehand in such a manner as described later.

As shown in FIG. 4, once the ink replenishing operation is started, the above described connection operation is performed at step S1, that is, the ink reserving section 10 is moved from the position shown in FIG. 2 to the position shown in FIG. 3. Then, at step S2, the supply valve 22 is opened, and at step S3, the replenishing process is executed. The replenishing process at the step S3 is shown in FIG. 5 in detail. When the replenishing process is started, a timer starts at step S21 to begin measuring the amount of time spent for the replenishing operation. Subsequently, it is determined at step S22 whether or not a switching signal indicating that the main power source has been cut off and that the power supply has been switched to the secondary power source has been transmitted to the control circuit 1 by means of interruption or the like. If the main power source 5 is being used to supply ink, the interruption of the switching signal does not occur, so the procedure proceeds to step S24 to calculate the amount of ink supplied. Then, it is determined at step S25 whether or not the replenishing operation has been completed. If the replenishing operation has not been completed, the procedure returns to the step S22 and if the replenishing operation has been completed, the timer is reset at step S26. Referring back to FIG. 4, the procedure proceeds to step S4 to close the supply valve 22. Then, at step S5, a separation operation is preformed so as to establish the initial positional relationship, that is, the one shown in FIG. 2, thereby finishing the ink replenishing operation control.

Figure 6:
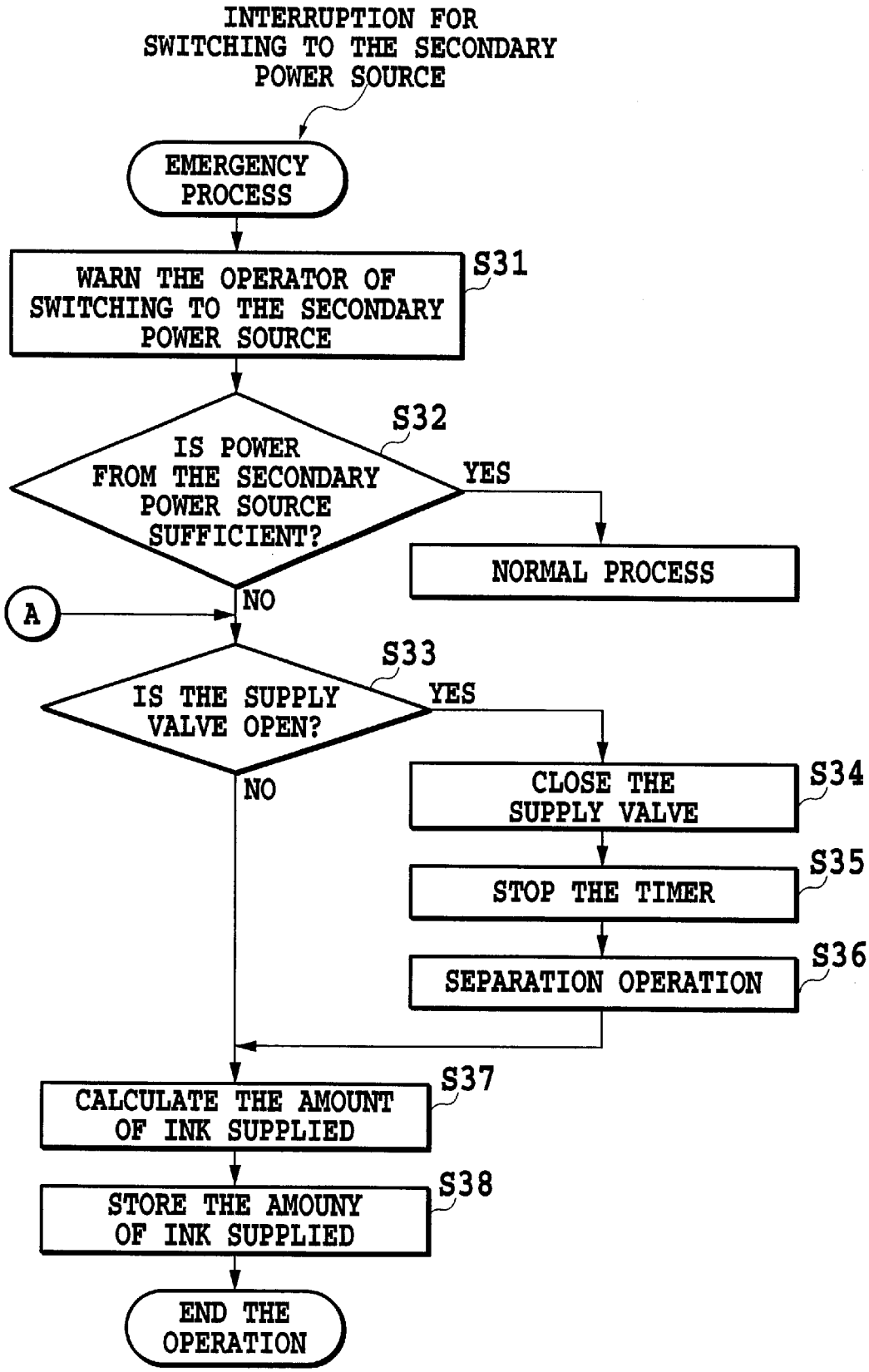
FIG. 6 is a flow chart showing emergent replenishing operation control of the first embodiment.

FIG. 6 is a flow chart useful in explaining the emergency replenishing operation control started when, after the start of the ink replenishing operation, the power supply from the main power source 5 stops due to a power failure or the like to cause the secondary power source 6 to start a power supply, while the power source switching control circuit 7 transmits a switching signal to inform the control circuit 1 of this switching by means of the interruption means. When the power supply from the main power source 5 stops before the start of the ink replenishing operation, the entire apparatus is stopped without switching to the secondary power source 6.

Various points of time when the secondary-power-source switching signal is transmitted to the control circuit 1 after the start of the ink replenishing operation are assumed. A description will be given of a case where while a normal replenishing process (step S3 in FIG. 4) is being executed under the ink replenishing operation control, the switching signal is provided to the control circuit 1 to inform it that the power source has been switched.

When the control circuit 1 is informed of the switching of the power source by means of interruption, at step S31, the operator is warned through an indicator or an alarm sound that the power supply has been switched to the secondary power source 6. Alternatively, if the interface connected to the printing apparatus can communicate with it in a bidirectional manner, the operator is warned of the switching via a host computer by, for example, displaying a message on the computer being used by the operator. Subsequently, at step S32, it is determined whether or not batteries constituting the secondary power source 6 are providing sufficient power.

If the secondary power source is, for example, nickel-metal hydride batteries, which has sufficient power to complete the ink replenishing operation (or the voltage at the secondary power source is sufficiently high), a replenishing process is executed which is substantially the same as that during the normal operation, as shown in FIGS. 4 and 5. That is, at step S22, it is determined whether or not the switching of the power supply to the secondary power source 6 by means of interruption has occurred. In this case, since such switching has occurred, the procedure proceeds to step S23 to determine whether or not the secondary power source is providing sufficient power. Since the power from the secondary power source is sufficient again, the procedure proceeds to step S24. Subsequently, as in the normal operation, the amount of ink supplied is calculated at the step S24, and it is then determined at step S25 whether or not the replenishing operation has been completed. If the replenishing operation has not been completed, the procedure returns to the step S22. Once the replenishing operation is completed, the timer is reset at step S26. Furthermore, at the step S4 in FIG. 4, the supply value 22 is closed, and at the step S5, the separation operation is performed to end the ink replenishing operation. After the ink replenishing operation has been finished, in contrast to the control provided during the normal operation, such control is provided that an operation such as printing is prohibited to restrain the consumption of power from the secondary power source until the main power source 5 is recovered.

Further, if the secondary power source is, for example, batteries, which have power insufficient to complete the ink replenishing operation but at least sufficient to close the supply valve 22 for the separation operation, then the operator is warned at step S31, and it is determined at step S32 that the secondary power source is not providing sufficient power, so that the procedure proceeds to step S33. At the step S33, whether or not the supply valve 22 is open is determined. In this case, since the ink replenishing process is being executed, the supply valve 22 is open and the procedure proceeds to step S34 to immediately close the supply valve 22. Then, at step S35, the timer is stopped, and at step S36, the separation operation is completed. Furthermore, at step S37, the amount of ink supplied before the supply valve 22 is closed is calculated, and at step S38, the amount of ink supplied is stored in the NVRAM, and the ink replenishing operation is then finished. In this case, the operation such as printing is prohibited until the main power source 5 is recovered as in the above described case where the secondary power source provides sufficient power. However, when the main power source 5 is subsequently recovered, the ink replenishing operation is performed again to supply an amount of ink sufficient to compensate for the shortage, that is, the required amount of ink supplied minus the amount of ink supplied as stored in the NVRAM.

Then, a method for calculating the amount of ink supplied to the ink reserving section after the supply valve has been opened and before the ink replenishing operation is suspended. Calculations or experiments are carried out to determine in advance the flow rate per unit time for each ink type (color type or composition), the channel resistance factor for a supply pipe for said each ink type, and the channel resistance factor for the supply pipe for each ink type as obtained when the ink viscosity changes due to a change in temperature, and the flow rate per unit time is stored, for example, in the ROM as table data, using a matrix of said ink type and said temperature. Then, the unit time flow rate dependent on the type of ink to be supplied and on the temperature during the replenishing operation is determined and multiplied by the amount of time required for the replenishing operation as actually measured after the supply valve 22 has been opened and before the ink replenishing operation is suspended, thereby making it possible to determine the amount of ink supplied to the ink reserving section.

Further, if the secondary-power-source voltage detector 7 detects, while the emergency replenishing operation control is being executed through the secondary power source 6, that the voltage at the secondary power source 6 has decreased down to a predetermined value or less, so that the ink replenishing operation cannot be completed, that is, it is determined at the step S23 in FIG. 5 that the power from the secondary power source is insufficient, the procedure proceeds to the step S33 in FIG. 6 to determine whether or not the supply valve 22 is open. In this case, since the ink replenishing process is being executed, the supply valve 22 is open and the procedure proceeds to the step S34 to immediately close the supply valve 22. Then, at the step S35, the timer is stopped, and at the step S36, the separation operation is completed. Furthermore, at the step S37, the amount of ink supplied before the supply valve 22 is closed is calculated, and at the step S38, the amount of ink supplied is stored in the NVRAM, and the ink replenishing operation is then finished. In this case, when the main power source 5 is subsequently recovered, the ink replenishing operation is also performed to supply an amount of ink sufficient to compensate for the shortage, that is, the required amount of ink supplied minus the amount of ink supplied as stored in the NVRAM.

In the above description of the emergency replenishing operation control with reference to FIGS. 5 and 6, the switching signal informs the control circuit 1 of the switching of the power source during the normal replenishing process under the ink replenishing operation control (the power supply from the main power source stops). The power supply from the main power source 5, however, is not stopped only during the normal replenishing process under the control of the ink replenishing operation control. The emergency replenishing operation control executed in other cases (for example, during the connection operation) have not bee described, but it is easily understandable from FIGS. 5 and 6 and the above description that similar control is provided in these cases.

Next, a second embodiment of the ink replenishing system of the present invention will be described with reference to FIGS. 7 and 8.

Figure 7:
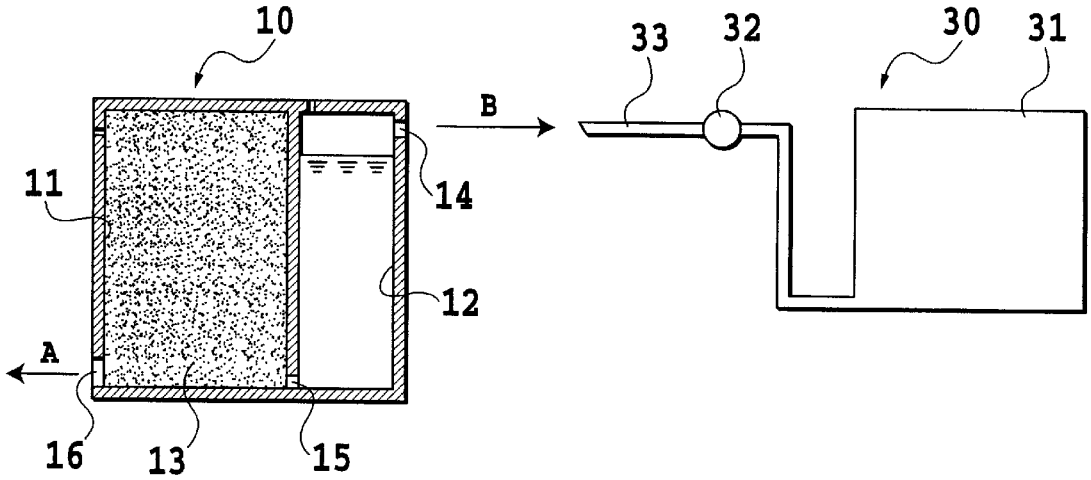
FIG. 7 is a view showing an ink replenishing system of a second embodiment, wherein an ink reserving section separates from an ink replenishing section.

In FIG. 7, the ink reserving section 10 is provided on the carrier (not shown) together with the print head as in the above first embodiment. The ink reserving section 10 has the first liquid chamber 11 and the second liquid chamber 12 which are in communication with each other via the communication passage 15. The first liquid chamber 11 is filled with the liquid absorbent 13 and has the supply passage 16 in communication with the print head (not shown). The ink stored in the second liquid chamber 12 gradually permeates through the liquid absorbent 13 through the communication passage 15. The ink permeating through the liquid absorbent 13 passes through the supply passage 16 to supply the print head with an amount of ink required for printing (the ink is supplied in the direction of an arrow A), as in the first embodiment.

An ink replenishing section 30 is fixed to a main body side of the ink jet printing apparatus. Although the ink replenishing section 30 differs from the first embodiment in that the ink is supplied by means of a pump 32, it has an ink storage chamber 31 for storing ink and a supply pipe 33 that can be connected to the opening 14 in the second liquid chamber 12 during the ink replenishing operation, as in the first embodiment. The pump 32 is configured to have its driving controlled by an actuator (not shown) so as to suck the ink from the ink storage chamber 31 and force it to the supply pipe 33.

Figure 8:
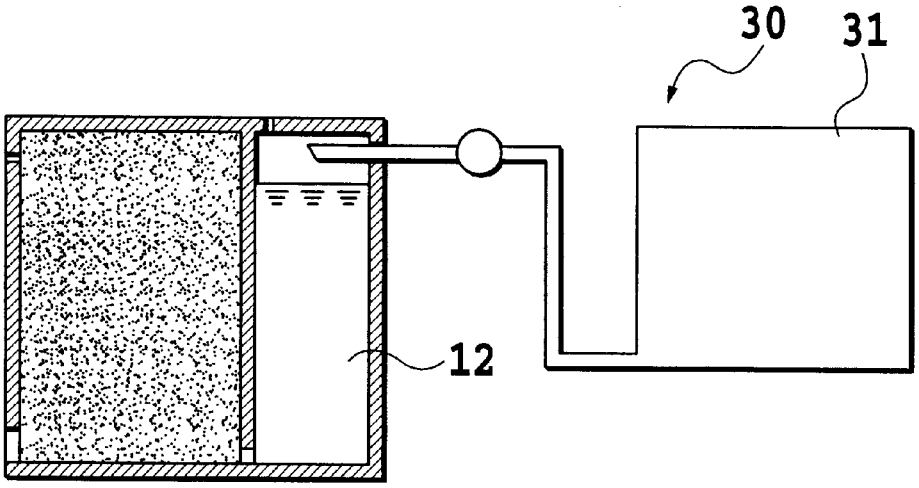
FIG. 8 is a view showing the ink replenishing system of the second embodiment, wherein an ink reserving section connects to an ink replenishing section.

During the ink replenishing operation, the carriage having the ink reserving section 10 mounted thereon is moved in the direction of the arrow B from its position shown in FIG. 7 and then stopped at its position shown in FIG. 8 ("connection operation"). The operation of the pump 32 is controlled to replenish the second liquid chamber 12 with a desired amount of ink from the ink storage chamber 31. Once the ink replenishing operation is completed, the pump 32 is stopped, the carriage having the ink reserving section 10 mounted thereon is moved in the direction opposite to that during the connection operation, so as to return to its state shown in FIG. 7 ("separation operation").

Ink replenishing operation control similar to that in the first embodiment is executed as the emergency replenishing operation control started when, after the start of the ink replenishing operation control and the ink replenishing operation, the power supply from the main power source 5 stops due to a power failure or the like to cause the secondary power source 6 to start a power supply, while the power source switching control circuit 7 informs the control circuit 1 of this switching by means of the interruption means.

In the two above described embodiments, the ink replenishing systems using the single type of ink have been described. The present invention, however, is applicable to color printers using inks of plural colors by providing as many ink replenishing systems as the colors.

The present invention provides a printing apparatus comprising an ink replenishing system moving a carriage having an ink reserving section of a print head mounted thereon in order to replenish the ink reserving section with ink, subsequently joining the ink reserving section to an ink replenishing section via a pipe, and then using an actuator to control a supply valve, a pressurization pump, or the like to feed ink from the ink replenishing section to the ink reserving section, wherein even if a power failure, accidental cutting of a power supply line, or the like occurs during an ink replenishing operation, the operation of the actuator is prevented from being immediately stopped and a separation operation is reliably completed by means of a secondary power source. Consequently, the movement of the carriage can be controlled, the valve or the pump can be prevented from being improperly controlled, and the ink can be prevented from leaking from connections or the like. Furthermore, if the ink replenishing operation is stopped before completion, the ink replenishing operation is performed again during the recovery of a main power source to supply an amount of ink sufficient to compensate for the shortage, thereby making it possible to properly manage the amount of ink in the ink reserving section.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink replenishing system for an ink jet printing apparatus for replenishing an ink reserving section of a print head with ink from an ink replenishing section, comprising:

said ink reserving section configured so as to be connected to and separated from said ink replenishing section via an opening formed in said ink reserving section; and said ink replenishing section configured so as to replenish said ink reserving section with ink by controlling driving of an actuator, wherein when a power supply from a main power source is cut off after a start of an ink replenishing operation, the power supply is switched to a secondary power source and replenishing control is executed depending on a power state of said secondary power source.

2. An ink replenishing system for an ink jet printing apparatus as claimed in claim 1, wherein when the power state of said secondary power source is such that the second power source has sufficient power to complete the ink replenishing operation, the ink replenishing operation is controlled so as to complete the connection operation, the ink replenishing operation, and the separation operation.

3. An ink replenishing system for an ink jet printing apparatus as claimed in claim 1, wherein when the power state of said secondary power source is such that it does not have sufficient power to complete said ink replenishing operation, said ink replenishing operation is suspended and at least the separation operation is completed, and the amount of ink supplied before the ink replenishing operation is suspended is stored, and wherein when the main power supply is subsequently recovered, the ink replenishing operation is performed again to replenish the ink reserving section with an amount of ink sufficient to compensate for the shortage.

4. An ink replenishing system for an ink jet printing apparatus as claimed in claim 1, wherein said secondary power source is chargeable batteries.

5. An ink replenishing system for an ink jet printing apparatus as claimed in claim 1, wherein a secondary-power-source voltage detector is provided for detecting a voltage at said secondary power source in order to detect the power state of said secondary power source, and a warning is issued if said detector detects a predetermined voltage or less.

6. An ink replenishing method for an ink jet printing apparatus for replenishing an ink reserving section of a print head with ink from an ink replenishing section, comprising steps of:

connecting said ink reserving section to said ink replenishing section via an opening formed in said ink reserving section;

replenishing said ink reserving section with ink from said ink replenishing section by controlling driving of an actuator; and separating said ink reserving section from said ink replenishing section, wherein when a power supply from a main power source is cut off after a start of an ink replenishing operation, the power supply is switched to a secondary power source and replenishing control is executed depending on a power state of said secondary power source.

7. An ink replenishing method for an ink jet printing apparatus as claimed in claim 6, wherein when the power state of said secondary power source is such that the second power source has sufficient power to complete the ink replenishing operation, the ink replenishing operation is controlled so as to complete the connection step, the ink replenishing step, and the separation step.

8. An ink replenishing method for an ink jet printing apparatus as claimed in claim 6, wherein when the power state of said secondary power source is such that it does not have sufficient power to complete said ink replenishing operation, said ink replenishing operation is suspended and at least the separation operation is completed, and the amount of ink supplied before the ink replenishing operation is suspended is stored, and wherein when the main power supply is subsequently recovered, the ink replenishing operation is performed again to replenish the ink reserving section with an amount of ink sufficient to compensate for the shortage.

9. An ink replenishing method for an ink jet printing apparatus as claimed in claim 6, wherein said secondary power source is chargeable batteries.

10. An ink replenishing method for an ink jet printing apparatus as claimed in claim 6, wherein a secondary-power-source voltage detector is provided for detecting a voltage at said secondary power source in order to detect the power state of said secondary power source, and a warning is issued if said detector detects a predetermined voltage or less.

* * * * *

UNITED STATES PATENT AND TRADEMARK OFFICE

CERTIFICATE OF CORRECTION

PATENT NO. : 6,386,690 B2
DATED : May 14,2002
INVENTOR(S) : Tetsuya Kawanabe

It is certified that error appears in the above-identified patent and that said Letters Patent is hereby corrected as shown below:

Title page,
Item [57], ABSTRACT,
Line 1, “A” should read -- The --.

Drawings,
Sheet 6, FIG. 6, “AMOUNY” should read -- AMOUNT --.

Column 3,
Line 50, “forms” should read -- form --; and
Line 51, “14” should read -- numeral 14 --.

Column 4,
Line 17, “shown” should read -- shown in --;
Line 32, “detector 7” should read -- detector 8 --; and
Line 64, “preformed” should read -- performed --.

Column 7,
Line 6, “bee” should read -- been --.

Column 8,
Line 26, “apparent” should read -- appended --.

Column 9,
Line 11, “steps” should read -- the steps --.

Signed and Sealed this

Eighth Day of October, 2002

*Attest:*

*Attesting Officer*

JAMES E. ROGAN
*Director of the United States Patent and Trademark Office*